US007811202B2

(12) United States Patent
Planke

(10) Patent No.: US 7,811,202 B2
(45) Date of Patent: Oct. 12, 2010

(54) TRAINING APPARATUS

(75) Inventor: Tore Planke, Borøy (NO)

(73) Assignee: Redcord AS, Staubo (NO)

( * ) Notice: Subject to any disclaimer, the term of this patent is extended or adjusted under 35 U.S.C. 154(b) by 304 days.

(21) Appl. No.: 11/576,924

(22) PCT Filed: Nov. 24, 2005

(86) PCT No.: PCT/NO2005/000438

§ 371 (c)(1),
(2), (4) Date: Aug. 14, 2007

(87) PCT Pub. No.: WO2006/057562

PCT Pub. Date: Jun. 1, 2006

(65) Prior Publication Data

US 2008/0293545 A1 Nov. 27, 2008

(30) Foreign Application Priority Data

Nov. 26, 2004 (NO) ..... 20045182

(51) Int. Cl.
*A63B 24/00* (2006.01)

(52) U.S. Cl. ..... 482/7; 482/24; 482/120; 482/143

(58) Field of Classification Search ..... 482/24, 482/38, 43, 69, 120, 124, 143, 907; 472/118, 472/119
See application file for complete search history.

(56) References Cited

U.S. PATENT DOCUMENTS 1,016,712 A * 2/1912 Schilling ..... 472/119
1,895,721 A * 1/1933 Mayo ..... 482/24
2,107,377 A * 2/1938 Howland ..... 482/43
2,564,547 A * 8/1951 Benton ..... 472/119
3,298,738 A * 1/1967 Shalhoob ..... 297/273
3,373,993 A * 3/1968 Oja et al. ..... 607/33
3,480,272 A * 11/1969 Ziebart ..... 472/20
3,692,305 A * 9/1972 Allen ..... 472/119
3,851,874 A 12/1974 Wilkin
3,981,500 A * 9/1976 Ryan ..... 248/274.1
4,052,070 A * 10/1977 Lew ..... 482/96
4,125,257 A * 11/1978 Lew ..... 482/43
4,431,184 A * 2/1984 Lew et al. ..... 482/43
4,449,716 A * 5/1984 Goldy et al. ..... 482/43
4,911,429 A * 3/1990 Ogbu ..... 472/119

(Continued)

FOREIGN PATENT DOCUMENTS

GB 2259864 3/1993

(Continued)

OTHER PUBLICATIONS

European Search Report, issued Dec. 9, 2009.

*Primary Examiner*—Fenn C Mathew
*Assistant Examiner*—Andrew M Tecco
(74) *Attorney, Agent, or Firm*—Rodman & Rodman

(57) ABSTRACT

A device for use with an exercise apparatus consisting of at least one hanging, length-adjustable and lockable rope (10, 11) which at its lower end has a gripping means (13, 14), e.g., a gripping loop. A vibration means (12; 16) is designed, when attached via a rope engaging member (8, 9) to a portion of such rope, to impart to the rope and thus its gripping means (13, 14) a vibratory motion.

9 Claims, 12 Drawing Sheets

U.S. PATENT DOCUMENTS

| | | | | | |
|---|---|---|---|---|---|
| 4,989,861 | A | | 2/1991 | Halpern | |
| 5,014,616 | A | | 5/1991 | Tapper | |
| 5,024,433 | A | * | 6/1991 | Mosberg | 482/96 |
| 5,064,191 | A | | 11/1991 | Johnson | |
| 5,158,516 | A | | 10/1992 | Johnson | |
| D342,771 | S | * | 12/1993 | Tandberg | D21/673 |
| 5,338,260 | A | * | 8/1994 | Smith | 472/118 |
| 5,480,375 | A | * | 1/1996 | La Fosse et al. | 601/23 |
| 6,024,648 | A | * | 2/2000 | Shurtleff et al. | 472/119 |
| 6,254,490 | B1 | * | 7/2001 | Lawson et al. | 472/119 |
| 6,361,446 | B2 | * | 3/2002 | Lawson et al. | 472/119 |
| 6,368,227 | B1 | * | 4/2002 | Olson | 472/118 |
| 7,044,896 | B2 | | 5/2006 | Hetrick | |
| 7,090,622 | B2 | | 8/2006 | Hetrick | |
| 7,294,095 | B2 | * | 11/2007 | Charnitski | 482/91 |
| 2005/0014616 | A1 | | 1/2005 | Tiahrt | |

FOREIGN PATENT DOCUMENTS

| | | | | |
|---|---|---|---|---|
| GB | 2259864 | A | | 3/1993 |
| SU | 1007684 | | | 3/1983 |
| SU | 1007684 | A | * | 3/1983 |
| SU | 1627197 | | | 2/1991 |
| WO | 2004020045 | | | 3/2004 |
| WO | WO2004/020045 | A1 | | 3/2004 |

* cited by examiner

TRAINING APPARATUS

The present invention relates to a device for use with an exercise apparatus consisting of at least one hanging, length-adjustable and lockable rope which at its lower end has a gripping means, e.g., a gripping loop.

Such exercise apparatus are known, e.g., in the form of so-called slings which, via guides in the ceiling or on a wall, are length-adjustable and can be locked via a rope fastener on, e.g., a wall. However, the solution requires that the slings be left in order to adjust the rope lengths, or that another person helps with the adjustment. An apparatus known as TrimMaster™ or TerapiMaster™ and manufactured by Nordisk Terapi AS in Norway has significantly improved the previously known solution, so that the apparatus user does not have to leave the gripping means or slings in order to make an adjustment of the rope length.

Such exercise apparatus are widely used for rehabilitation, strength training and mobility training of patients in hospitals and physiotherapeutic institutes, or they are used in fitness studios and in fitness rooms at places of work or in private homes.

Although much of this kind of exercise performed using such apparatus has been found to be of great help, often accompanied by expert guidance from a physiotherapist or the like, it has been shown recently that the treatment of certain disorders, in particular those associated with varying degrees of pain at joints and in the spinal column, has a faster and longer-lasting effect if the joints are further provoked by treatment and exercise under very unstable conditions.

Therefore, more recently, attention has been focused on why active, volitional muscle training does not always give the expected results, even with optional heat treatment and help from assisting personnel, such as physiotherapists or doctors.

In an article published in FYSIOTERAPEUTEN No. 12/2000, pages 9-16, physiotherapist Gitle Kirkesola has described a concept for active treatment and exercise for disorders of the musculoskeletal apparatus under the designation "Sling Exercise Therapy" (SET).

In this article it is pointed out that long-term disorders of the motor apparatus are associated with physiological changes in the body, such as reduced sensomotory control, reduced strength and endurance of the stabilising musculature, reduced strength and endurance of the motor musculature, muscular atrophy and reduced cardiovascular function.

More recent studies indicate that certain muscles have a quite special stabilising function, namely the local or "unconscious" muscles that are close to joints and have a majority of tonic muscle fibres. Such local muscles are believed to be responsible for segmental stability, whilst global muscles perform movements.

On, e.g., sudden movements of the upper body or the extremities, it is precisely the local stabilising muscles that are activated by what is called a "feed forward mechanism". Documentation has shown that patients with chronic back conditions have lost their feed forward mechanism to the transversus abdominis. In connection with persistent afflictions, e.g., back conditions, it is a known phenomenon that there is a reduction in sensomoto control. The training of sensory muscular activity is therefore essential.

It has been discovered that the effect of training up the local stabilising musculature is enhanced if the patient is exposed to a certain degree of instability. This may be done by having the patient, e.g., stand upright on, kneel on or sit on an unstable cushion with his hands gripping the slings, or by having the patient, e.g., lie on his back with an unstable cushion under his buttocks and his legs placed in the slings.

The exercise time required here will in some cases not be within the usual standard treatment programme in a physiotherapeutic institute. The article concludes that it may therefore be advantageous, if not necessary, that the patient should also have an exercise programme that is possible to follow at home.

Local stabilising musculature is thus small muscle groups which cannot be controlled by conscious will, but which the brain unconsciously controls when it receives the right signals. Such local musculature ensures stability of the joints and prevent abnormal joint dislocations, but when the joints are under great strain and there is pain, this control function may be put out of action and is not easily restored. It is envisaged that if the brain is stimulated to perceive an abnormality or a state of danger in an area of the stabilising musculature, it will—without the person in question being able to control this—restore signals to this musculature, which signals are adapted to ensure that the local muscles surrounding the joints are stimulated to be activated.

It is a known fact that walking in woodland or the like on rough ground is an effective strength training for the body musculature. The brain will in these cases instinctively register any danger of instability and overstepping if the local stabilising musculature in, e.g., the ankle joints is not kept constantly active. The brain will also unconsciously register danger signals as regards the muscles of the back when walking on rough ground or in terrain where there is a great risk of the walker losing his balance, and thus the stabilising muscles of the back will be stimulated unconsciously by the brain to "exercise" the stabilising musculature close to the joints.

In the light of such practical experience, it has been concluded that some joint pain, which in fact often travel to other parts of the body, may indeed be due to the fact that the local or "unconscious" stabilising musculature have wholly or partly lost communication with the brain, and that this communication under certain circumstances can be stimulated.

Tests that have been carried out where at least parts of the body are subjected to imbalance, e.g., in that a person is supported by an unstable surface, even when the joint is loaded, optionally with volitional muscular movement in addition, have shown that even short-term treatment and exercise under such instability-prevailing circumstances give considerable relief and in many cases elimination of joint pain, whilst the original functionality is restored.

Additional tests have shown that if instability is implemented via an exercise apparatus as defined above, or as a supplement to other instability, significant alleviation of joint pain associated with weak, local or "unconscious" stabilising musculature at one or more joints can be obtained.

However, it has been seen to be desirable to be able to make the treatment programme using SET even more effective and thus reduce the treatment time, and it is this goal that the present invention aims to achieve.

According to the present invention, the object is therefore to provide a device of the type mentioned above which makes it possible to achieve this goal, and where such a device is simple in its function, easy to manufacture, easy to operate and inexpensive to purchase and run.

According to the invention, the device is characterised by a vibration means designed, when attached via a rope engaging member to a portion of such rope, to impart to the rope and thus the gripping device a vibratory motion.

Further testing of the aspects that form the basis of the present invention has confirmed that when training up the stabilising musculature, a considerably greater effect will, according to the invention, be obtained when using SET if the slings are made to vibrate, so that the user finds them significantly more unstable and not least even more provoking when it comes to maintaining balance in all the joints of the body.

Additional embodiments of the device will be apparent from the attached subsidiary claims, and from the following description with reference to the attached drawing figures.

Figure 9A:
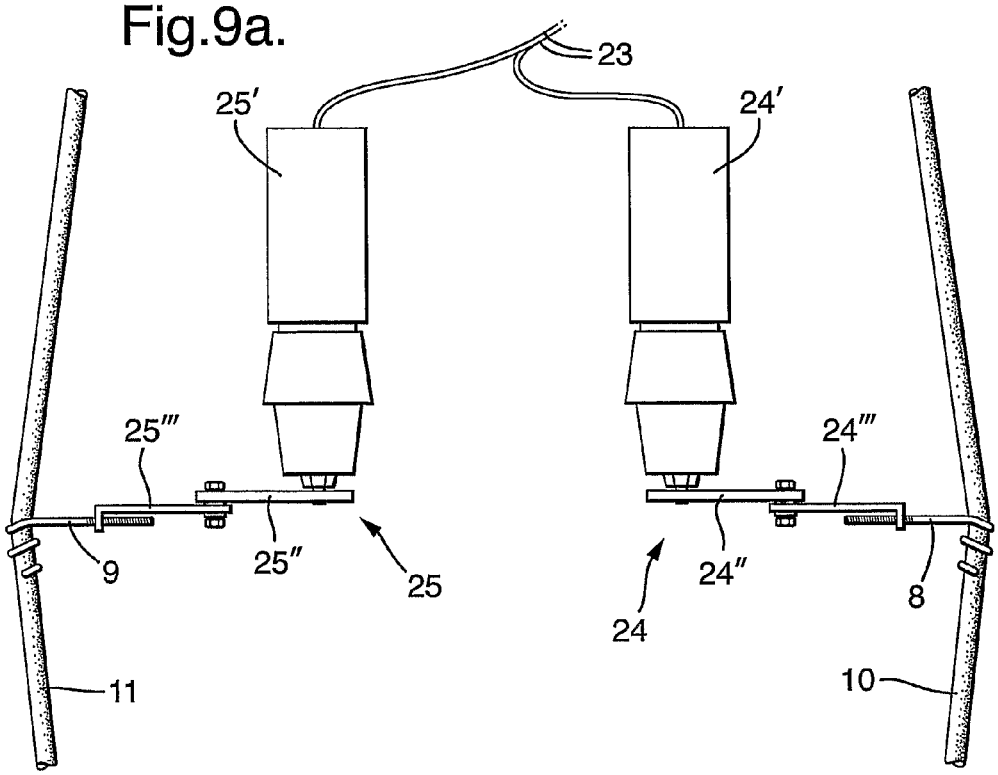
Figure 9B:
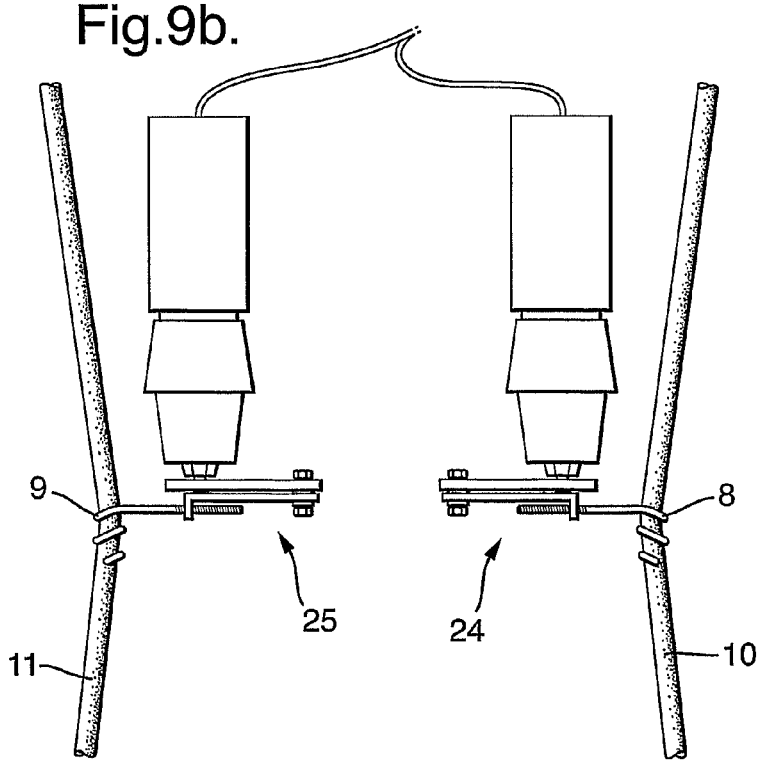

FIGS. 9*a* and 9*b* show a first embodiment of the device according to the invention.

Figure 10:
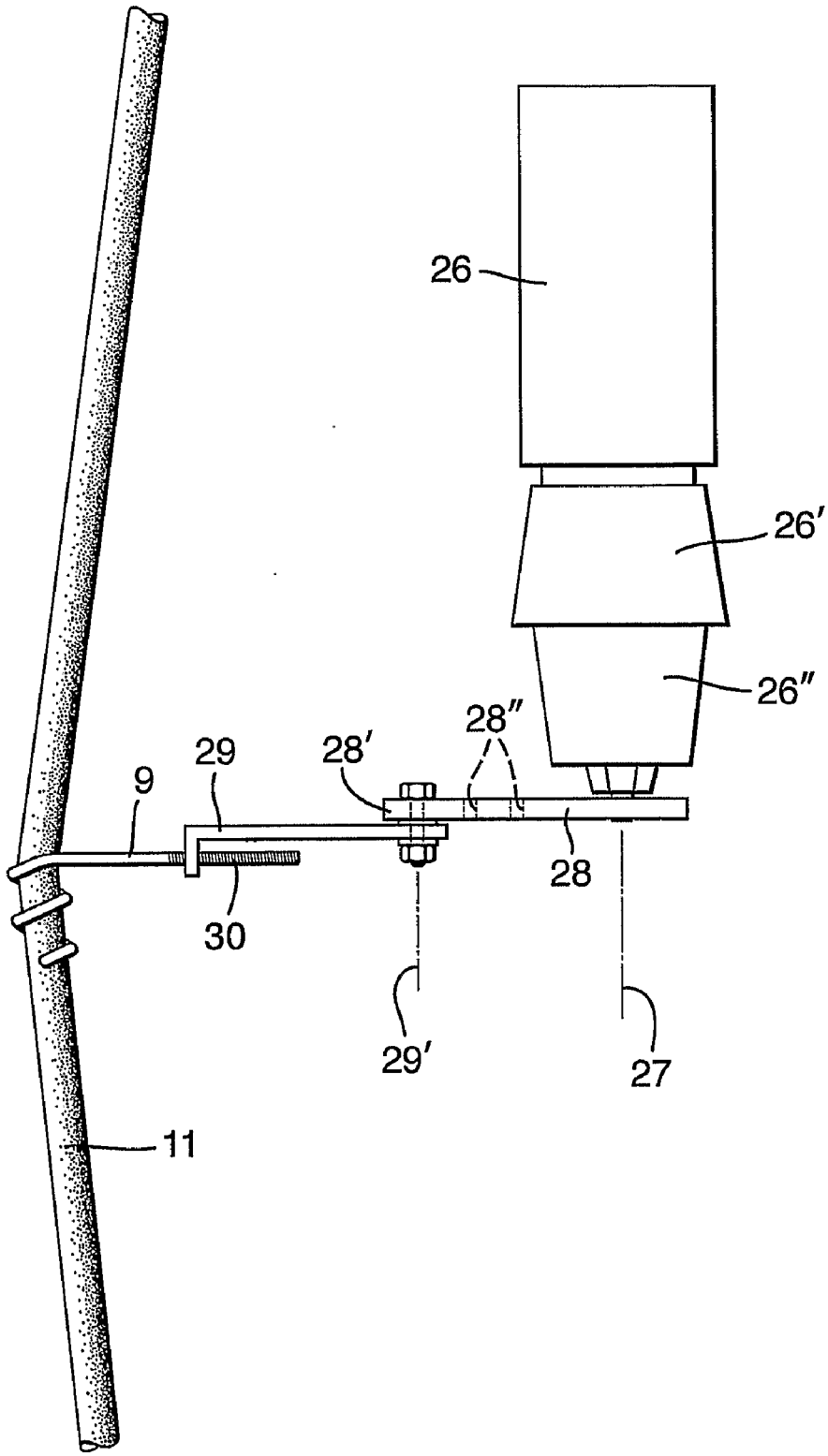

FIG. 10 shows a closer detail of a part of the device shown in FIGS. 9*a* and 9*b*.

Figure 11:
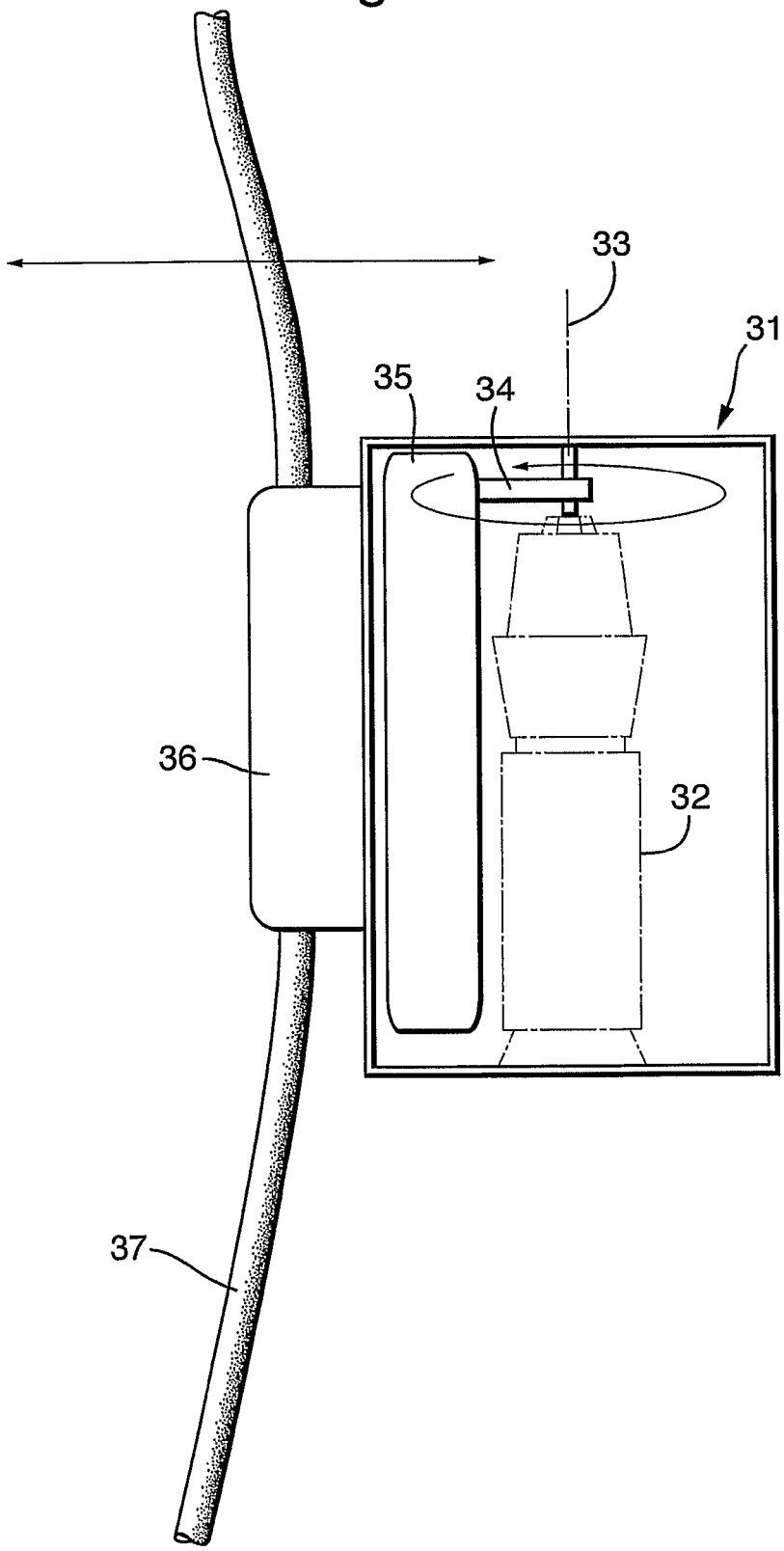

FIG. 11 shows a variant of the device according to the invention.

Figure 12:
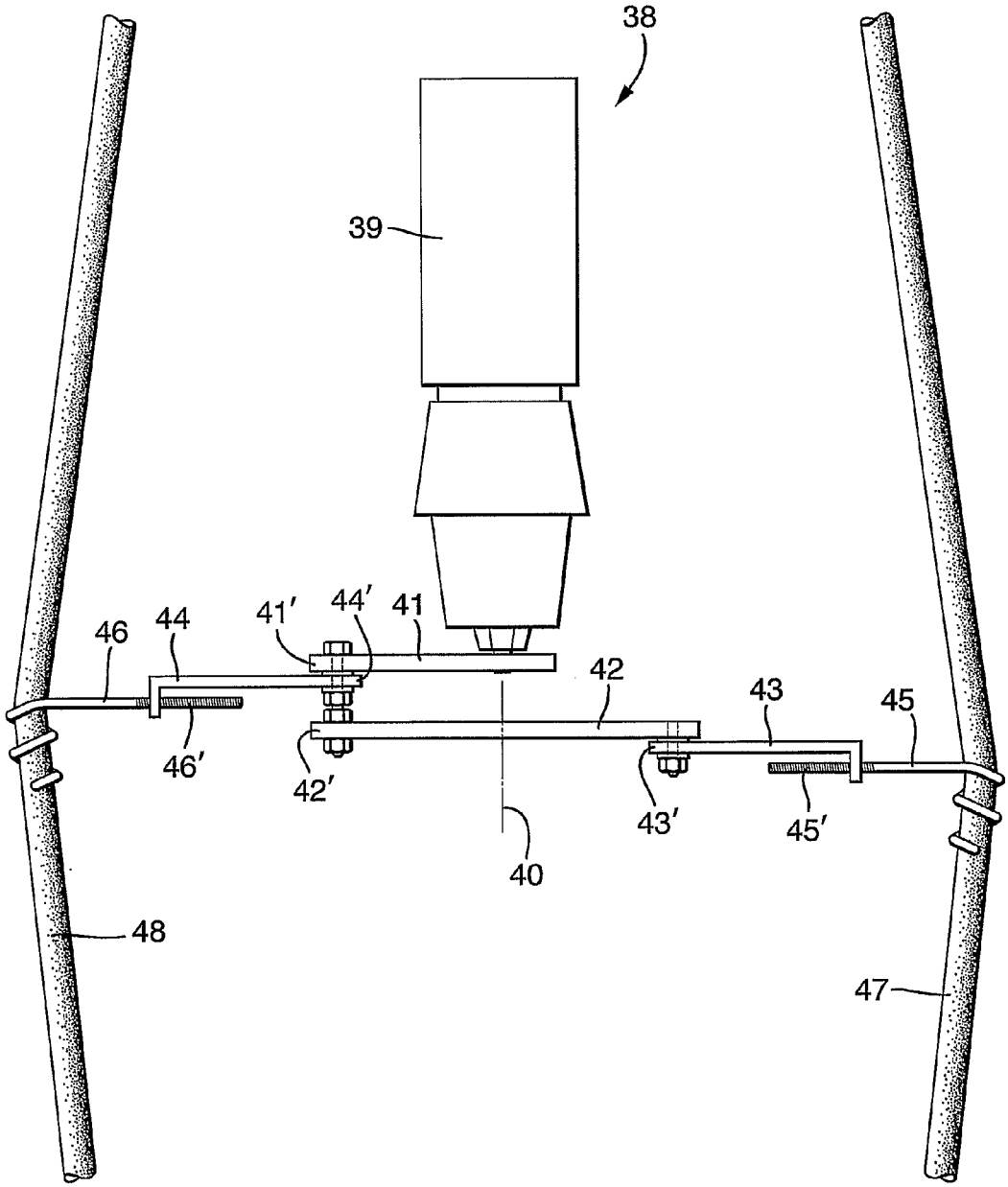

FIG. 12 shows a variant of the device shown in FIGS. 9*a* and 9*b*.

Figure 13:
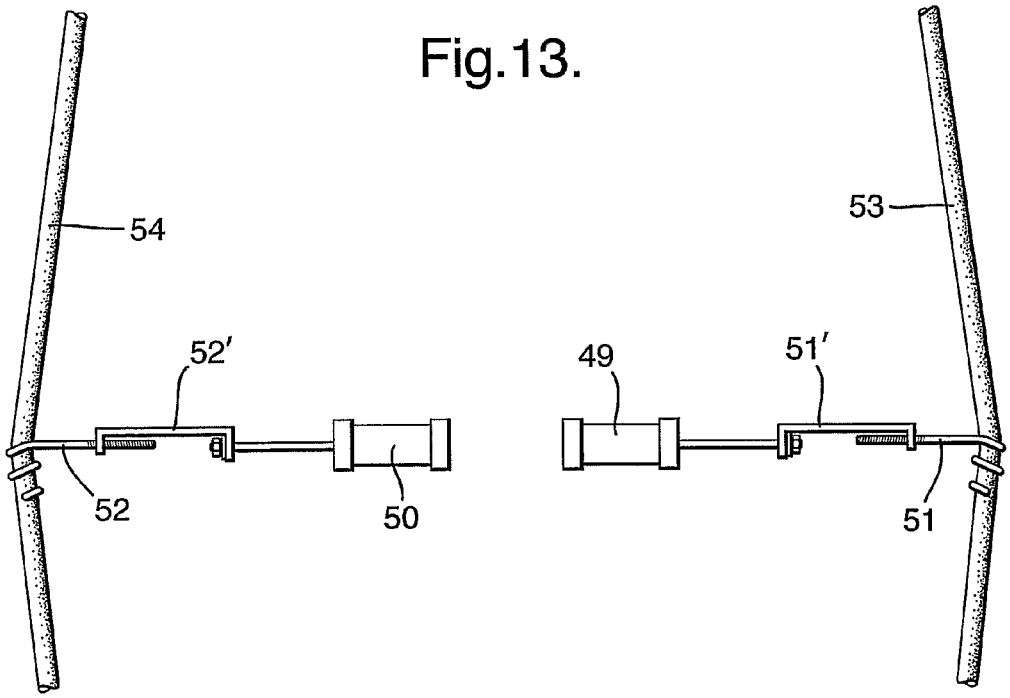

FIG. 13 shows another variant of the device, where a pneumatic system is used.

Figure 14A:
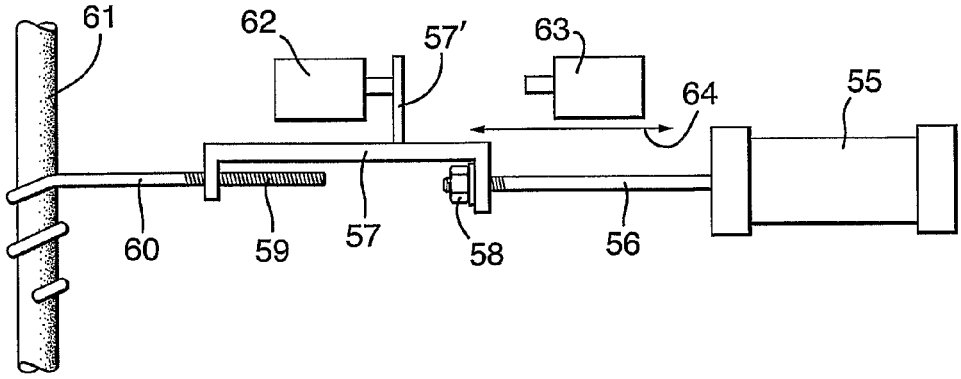
Figure 14B:
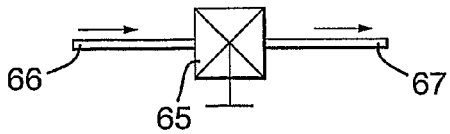

FIGS. 14*a* and 14*b* show details of the device shown in FIG. 13 for control of speed and length of stroke.

Figure 15:
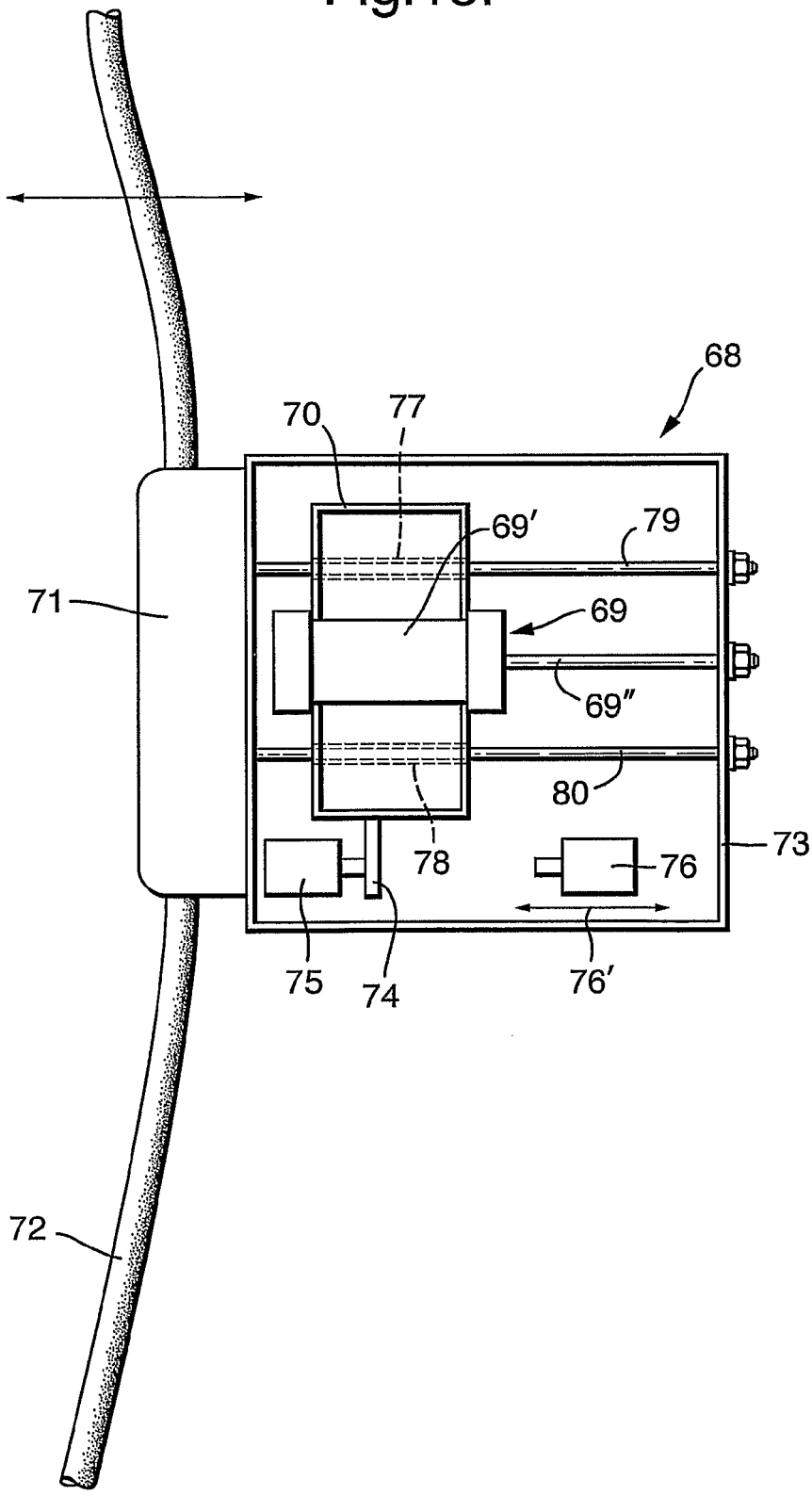
Figure 16:
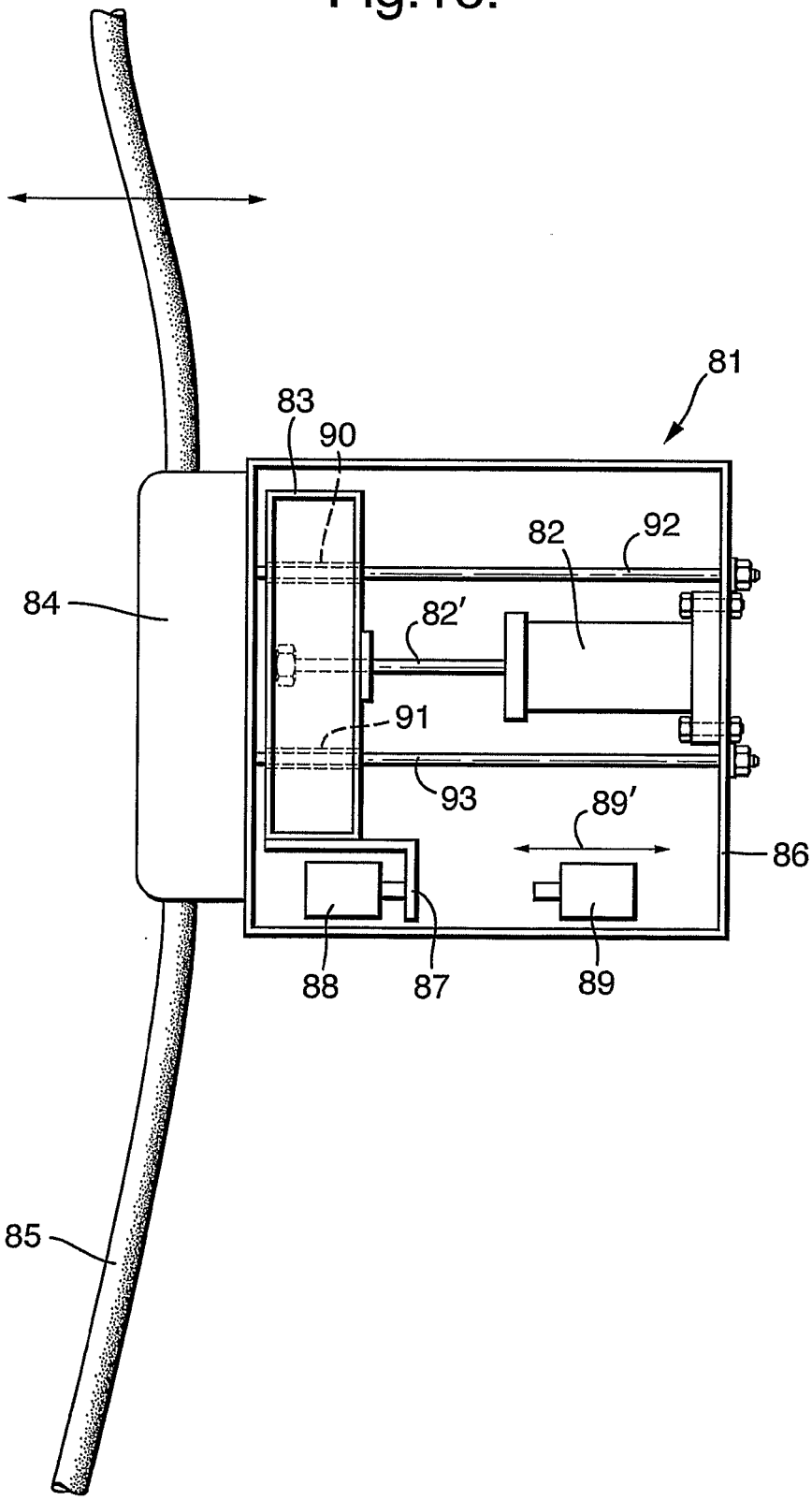

FIGS. 15 and 16 show variants of the device shown in FIG. 11 designed for pneumatic operation.

In the solutions shown in FIGS. 1-6, the user 1 uses a so-called "wobble cushion" 2 in cooperation with the slings 3, 4 and where ropes 10, 11 from a TerapiMaster™ 5 are included in order to create an instability situation and thus help to ensure that sensomotor control is stimulated, i.e., that the brain discovers a clear instability situation in the local or unconscious muscles close to the joints. This means that these muscles will increase their tightening and stabilising function, which in turn will help to ensure that joint pain and related pain diminishes.

Figure 1:
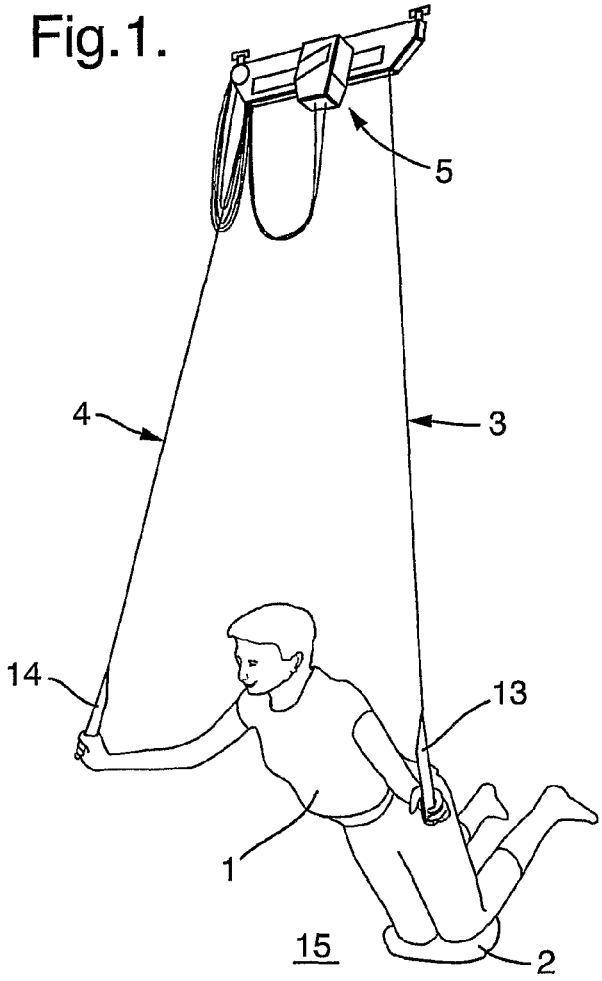
FIG. 1 shows the known principle for kneeling forward falls or push-ups using a TerapiMaster™ together with a "wobble cushion" to create instability.
Figure 2A:
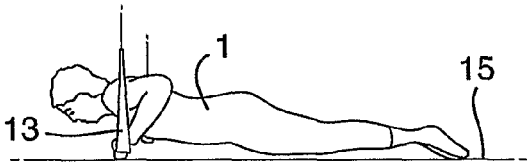
FIG. 2 shows the known principle for an alternative push-up exercise when using a TerapiMaster™.
Figure 2B:
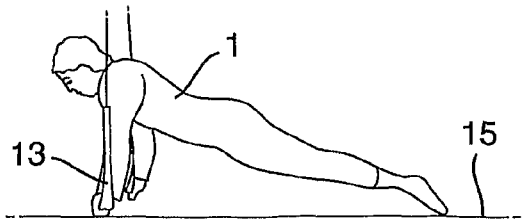
Figure 3:
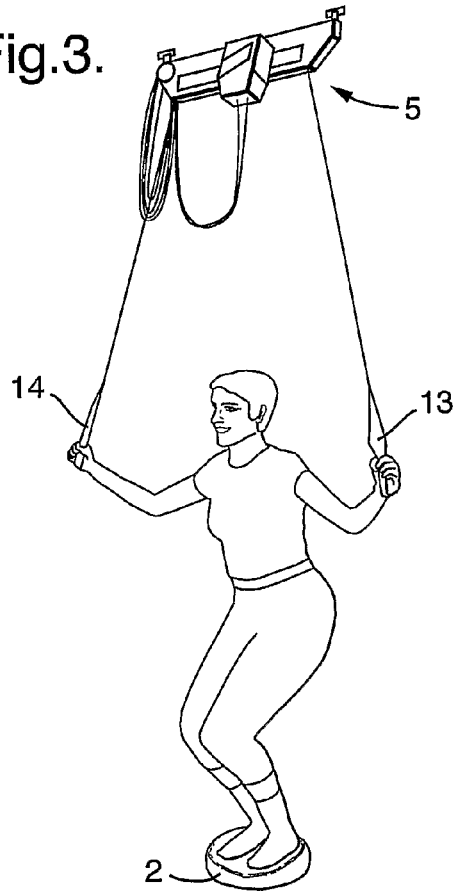
FIG. 3 shows the known principle for a standing balance exercise for sensomotory control.
Figure 4:
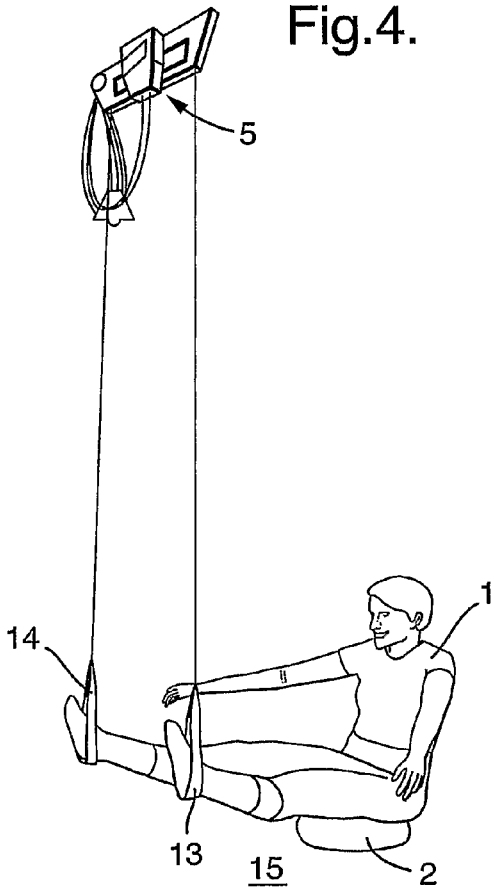
FIGS. 4 and 5 show the known principle for a sitting balance exercise for sensomotory control.
Figure 5:
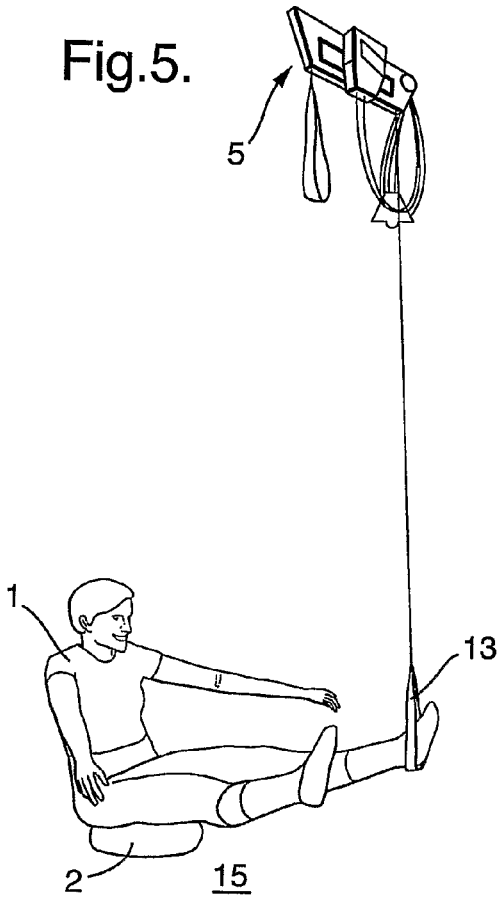
Figure 6:
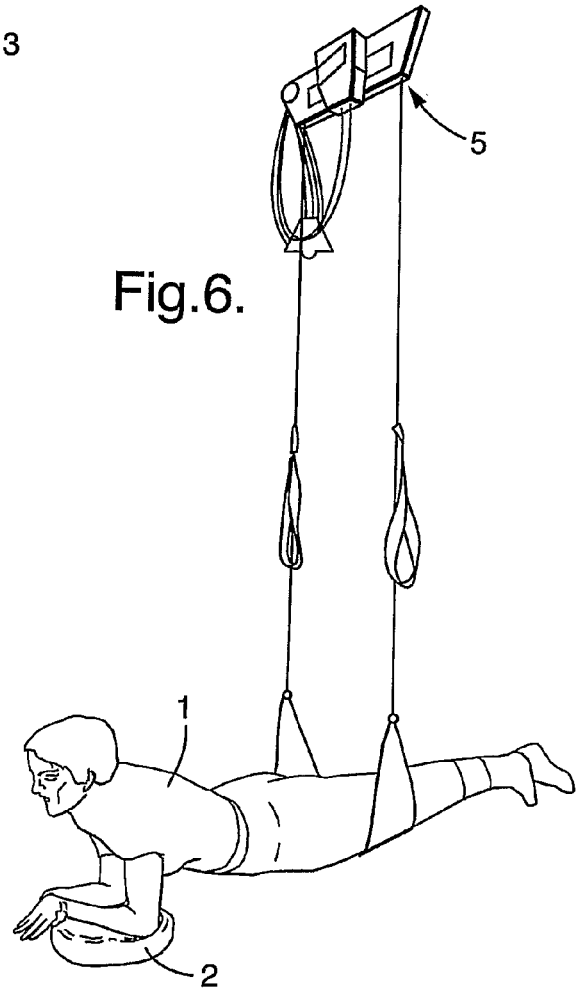
FIG. 6 shows the known principle for a lying elbow-supported position for a sensomotory control exercise.

FIG. 1 shows kneeling forward falls or push-ups using a TerapiMaster™ 5 together with a "wobble cushion" 2 to create instability. Tests have shown that this has a positive effect not least on shoulder joint disorders. FIG. 2 shows an alternative push-up exercise when using TerapiMaster™ 5, where instability is partly created by the user 1 stretching out until his body is straight, and where his arms are supported by the gripping means 13, 14 such as gripping loops, and where extra instability is created in that the user has only his toes resting against a surface 15. FIG. 3 shows a standing balance exercise for sensomotory control of, inter alia, the back, and alternative exercises are shown in FIGS. 4 and 5 with a sitting balance exercise, and in FIG. 6 with a lying, elbow-supported position for the sensomotory control exercise.

Figure 7:
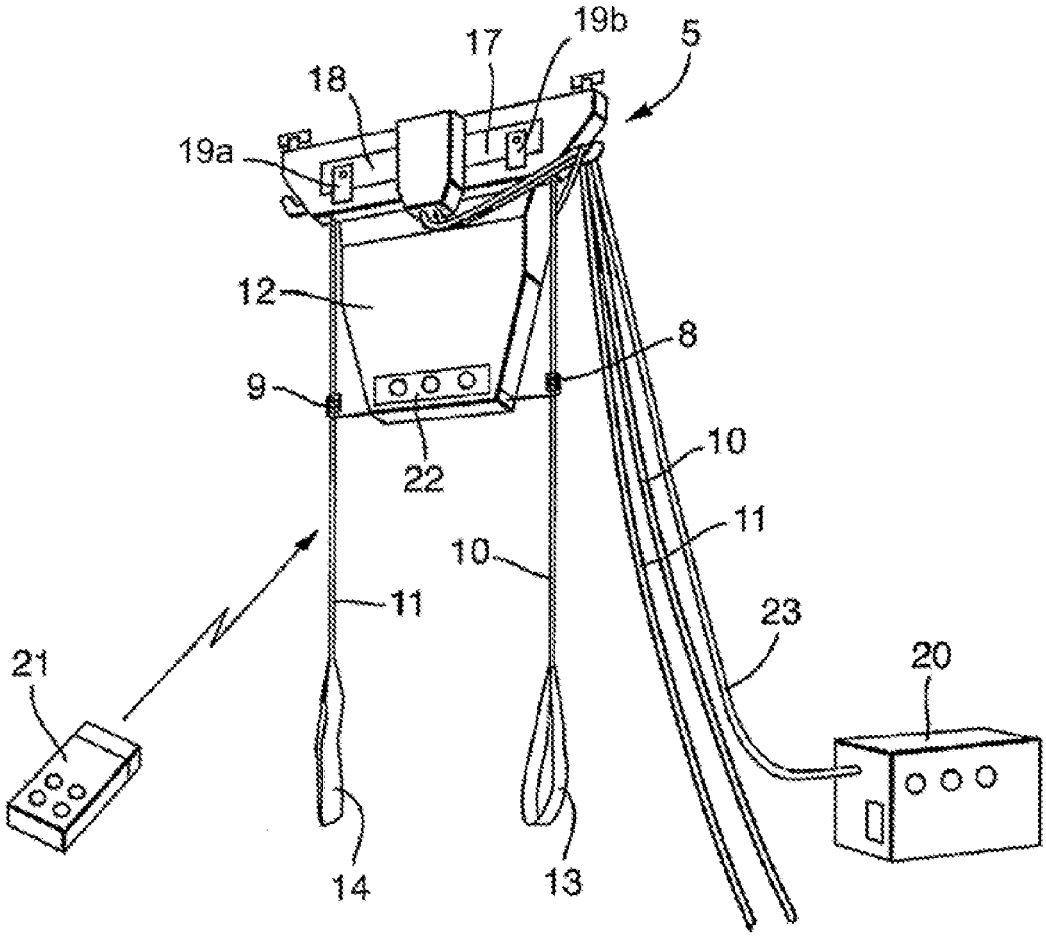
FIG. 7 shows the device according to the invention mounted on a TerapiMaster™.

FIG. 7 shows a solution where the device, indicated by the reference numeral 12 in this figure, is suspended from and locked to a TerapiMaster™ via mounting pieces 17, 18 and locks 19*a*, 19*b*. If the device 12 is to be used with conventional "slings" or rope, the possibility of which was indicated above, it would be appropriate to suspend the device 12 in a frame or from a ceiling (not shown). The device is advantageously operated from a power unit, e.g., an adjustable power source or a compressed air source 20 which can be operated either manually or via a remote control unit 21 which the user can have readily available. The remote control may take place via a suitable means 22 on the device itself, or directly to the source 20. It is also conceivable that the means 22 is manually operable as an operable alternative or supplement to the remote control possibility. Power transmission from the unit 20 to the drive means in the unit 12 takes place via cable 23. Speed control may be step-by-step or stepless, and the speed controller may be located inside the device 12 housing, or be remote from said housing.

Although it has been shown and described that power supply can be provided via cable 23, it will be understood that with the correct choice of powerful and light batteries in, e.g., the device housing, the user will not be dependent on cable 23, which in some cases may be found to get in the way of a training exercise. The possibility of charging such batteries, preferably by quick charge, should be present.

Figure 8:
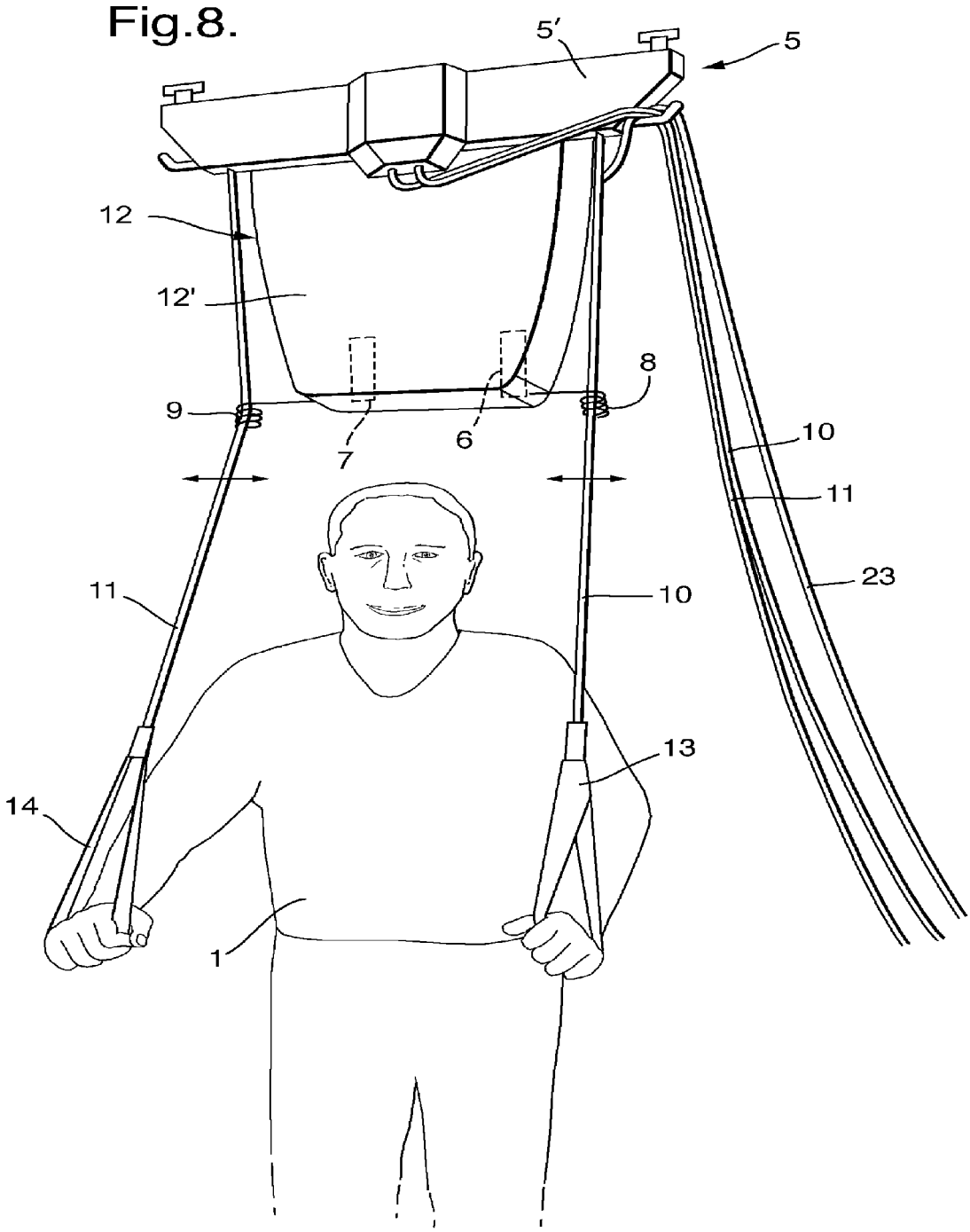
FIG. 8 shows the device according to the invention used for arm exercises or shoulder exercises and integral with a TerapiMaster™.

FIG. 8 shows how the housing 12' of the device 12 may, e.g., be made in one piece with housing that is part of the device 5, indicated in this figure by the reference numeral 5'. The device 12 has rope engaging members 8, 9 which cooperate with respective ropes 10, 11 in order to impart to these ropes vibratory motion from a respective vibratory means 6, 7, as will be explained in more detail in connection with inter alia, FIGS. 9*a* and 9*b* and FIG. 10 below.

FIGS. 9*a* and 9*b* show a first embodiment of the device, preferably intended for cooperation with a TerapiMaster™, where the vibration means 6, 7 is designed, when attached via respective rope engaging members 8, 9 to a portion of a respective rope 10, 11 to impart to the rope and thus its respective gripping means 13, 14 (see FIGS. 7 and 8) a vibratory motion.

As shown in FIGS. 9*a* and 9*b*, the exercise apparatus has two hanging, length-adjustable and lockable ropes 10, 11 (see also FIGS. 7 and 8 with gripping means 13, 14). In these figures it is shown that the vibration means has two rope engaging members 8 and 9, each of which is designed to be fastened to a respective one of the ropes 10 and 11 for vibration of the ropes.

The vibration means 6, 7 has at least one drive means 24, 25 (see FIGS. 9 and 10) with a rotating arm 28, transverse to the rotational axis 27 of a motor 26, which at a, in functional terms, outer end 28' is pivotally fastened to a link 29 which is associated with the rope engaging member 9. It will be seen especially from FIG. 10 that the distance of the rope 11 from the link 29 is adjustable, the member 9 being adjustably fastened to the link 29, e.g., via a screw connection 30. The drive means 26 in FIGS. 8 and 10 may optionally have momentum coupling 26' and a fastening means 26" for fastening to the rotating arm 28.

On studying FIGS. 9 and 10, it will be understood that the enlarged drawing in FIG. 10 can similarly be used to understand the mode of operation of the drive means 24 related to the rope 10.

In the solution shown in FIG. 11 there is a vibration means 31 in the form of at least one drive means or motor 32 with a rotating arm 34 transverse to the rotational axis 33 of the motor, which at an outer end is fastened to a non-balanced, i.e., eccentrically mounted, weight body 35 for rotation thereof. The vibration means 31 has means 36, e.g., a cleat lock, for direct attachment to a rope 37.

In the solution shown in FIG. 12 there is a vibration means 38 which comprises a common drive motor 39 for the pair of ropes, wherein the drive motor 39 is equipped with a rotating arm 41 transverse to the rotational axis 40 of the motor which at an outer end 41' is fixedly secured to one end 42' of a link 42, and where the other end 42" of the link 42 is pivotally fastened to a link 43, so that the centres of rotation 43' and 44' for the two links 43 and 44 move 180° offset relative to each other. The links 43 and 44 are associated with the respective rope engaging member 45, 46 which is fastenable to a respective rope 47, 48.

As shown in FIGS. 9*a* and 9*b*, the vibration means 24, 25 comprises two drive motors 24', 25' which via respective links 24", 24'" and 25'" and rope engaging members 8, 9 are designed to cause a respective rope 10, 11 to vibrate.

In the alternative shown in FIG. 13, the vibration means 12 consists of at least two pneumatic actuators 49, 50 which are connected to a respective rope engaging member 51, 52 for a rope 53, 54 optionally via a respective, adjustable link 51', 52". Although two pneumatic actuators are used in this case, only one actuator will of course be used for one rope. It would also be possible to use a double acting actuator (not shown), which either pushes the ropes away or draws them in, or where one of the ropes is pushed away whilst the other is drawn in, and vice versa.

As can be seen from the solutions shown in FIGS. 9, 10, 12, 13 and 14 the said links which are attached to the drive motor or actuator are length-adjustable. In FIG. 10 and thus also FIG. 9 the adjustability of the member 9 via the screw connection 30 is apparent. It will also be seen that the length adjustment of the link 28 is possible by moving the axis of rotation 29' to the position of one of the holes 28". FIG. 12 similarly shows the length adjustability of the respective screw connections 45' and 46'.

FIG. 14*a* shows by way of example an actuator, such as one of the actuators 49, 50 in FIG. 13. In this figure the actuator is indicated by means of the reference numeral 55 and has a piston rod 56 at one end of which is fastened a link 57 via a screw-nut connection 58. At its other end, the link 57 is via a screw connection 59 adjustably connected to a rope engaging member 60 which engages with a rope 61. The link 57 may have a guide pin 57' designed to cooperate with control valves 62, 63 which control the strokes that the actuator 55 is to make. The valve 63 is indicated as being adjustable by the arrow 64, i.e., that the pin 57' in cooperation with the valves 62, 63 controls correct operation of the actuator 55. It is of course possible that the valve 62 alternatively or additionally may also be position-adjustable.

FIG. 14*b* shows that the actuator 55 can be made adjustable not only as regards the control of stroke length, as shown in FIG. 14, but also as regards stroke speed, where for the last-mentioned there is used an airflow regulator 65 for adjusting the ratio between supply air 66 to the actuator(s) and exit air 67 from the actuator(s).

As shown in FIGS. 7 and 8, the vibration means 12 will have a housing 12' which contains said at least one drive motor or said at least one pneumatic actuator, wherein at least a part of said link with rope engaging member projects from the housing.

As regards the solution shown in FIGS. 13 and 14, it will be seen as natural to allow said valves and/or stroke speed controller to be located inside the vibration means housing or at a distance from the vibration means.

In the double-motor solution shown in FIGS. 9*a* and 9*b* it is possible to allow the ropes to move synchronously or asynchronously. In the solution shown in FIG. 13 there is a synchronous oscillation of the ropes whilst the solution in FIG. 12 means that each pneumatic cylinder 49, 50 can be controlled individually and thus either synchronously or asynchronously, as for the solution shown in FIGS. 9*a* and 9*b*.

On synchronous control and thus synchronous oscillation it is conceivable that each vibration means, as for example the means shown in FIG. 11, is fastened directly to the rope, e.g., by a cleat lock. The same will also be possible for a solution with a pneumatic actuator, where the reciprocating movement of the cylinder part of the actuator will cause vibrations of the associated rope. Asynchronous oscillation is obtained by different, synchronous control.

Asynchronous movement of the ropes will further provoke the local stabilising musculature. Of course, this is not necessary, but has been found to further improve the treatment.

FIG. 15 shows a variant of the solution in FIG. 11 intended for pneumatic operation. The mode of operation is essentially as shown and explained in connection with FIG. 14. In the solution shown in FIG. 15 there is a vibration means 68 in the form of at least one pneumatic actuator 69 with a weight body 70 mounted on the actuator cylinder 69' for rotation thereof. The vibration means 68 has means 71, e.g., a cleat lock, for direct attachment to a rope 72 which is to be made to vibrate. The actuator piston rod 69" is fastened to the vibration means housing 73. Arranged on the weight body 70 there may be a guide pin 74 designed to cooperate with control valves 75, 76 which control to and fro the strokes that the actuator 69 is to execute. The valve 76 is indicated as adjustable by the arrow 76', i.e., that the pin 74 in cooperation with valves 75, 76 controls correct operation of the actuator 69. It is of course possible that the valve 75 alternatively or additionally may also be position-adjustable. The weight body 70 can slide in guides 77, 78 along guide bars 79, 80.

In the variant of FIG. 15 which is shown in FIG. 16 there is a vibration means 81 in the form of at least one pneumatic actuator 82 with a weight body 83 mounted on the actuator piston rod 82' for rotation thereof. The vibration means 81 has a means 84, e.g., a cleat lock, for direct attachment to a rope 85 which is to be made to vibrate. The actuator cylinder 82" is fastened to the vibration means housing 86. Arranged on the weight 83 there may be a guide pin 87 designed to cooperate with control valves 88, 89 which control the to and fro strokes that the actuator 82 is to perform. The valve 89 is indicated adjustable by the arrow 89', i.e., that the pin 87 in cooperation with the valves 88, 89 controls correct operation of the actuator 82. It is of course possible that the valve 88 alternatively or additionally also may be position-adjustable. The weight body 83 can slide in guides 90, 91 along guide bars 92, 93.

It would be conceivable that also the device shown in FIGS. 15 and 16 may have speed control as shown in FIG. 14*b*, or be connected to such control in connection with the air supply line to the actuator 69.

For reasons of clarity, the connecting lines to the drive motor have not been shown in FIGS. 8, 9*b*, 10 and 11, but the skilled person will immediately understand how power supply cable 23 should be connected. Also for reasons of clarity, pneumatic lines have not been shown in FIGS. 14 and 15, but the skilled person will immediately understand how they should be mounted, not only in FIG. 15 but also in FIG. 14.

The invention claimed is:

1. A device for an exercise apparatus, having two hanging, length-adjustable and lockable ropes which at its lower end have gripping means, the device further comprising, a vibration means configured when attached via a rope engaging member to a portion of such rope, to impart to the rope and thus its gripping means a vibratory motion, the vibratory means having two rope engaging members, each of which is designed to be fastened to a respective one of the ropes for vibration of the ropes, and the vibration means having one common drive motor for the pair of ropes, the drive motor being equipped with a rotation arm transverse to the rotational axis of the motor, which at one outer end is pivotally fastened to a first set of links which is associated with a first rope engaging member, and is also rigidly fastened to a first end of a first link in a second set of links, and that the first link in the second set at its second end is pivotally connected to another link in the second set which is associated with a second rope engaging member.

2. A device as disclosed in claim 1, wherein said links are length-adjustable.

3. A device as disclosed in claim 1, comprising a controller for stepwise or stepless speed control of the vibration means.

4. A device as disclosed in claim 1, wherein the vibration means has a housing, and wherein the rope engaging member projects from the housing.

5. A device as disclosed in claim 3, wherein the speed controller is located at a distance from the vibration means.

6. A device as disclosed in claim 1, wherein the vibration means being designed to cause two ropes to vibrate simultaneously; and wherein the vibration means being controllable to make the ropes vibrate synchronously.

7. A device as disclosed in claim 3 wherein the speed controller is located inside a housing of the vibration means.

8. A device as disclosed in claim 1, wherein said gripping means is a loop or a sling.

9. A device for an exercise apparatus, having an overhead support comprising, means for suspending the device from an overhead support, a rope or a pair of ropes which have a lower end with a sling or gripping means engageable by a selected part of a person's body, the device further including a vibration controllable powered vibration means having a rope engaging means for engaging a portion of the rope or ropes, to impart to the rope or ropes and thus its gripping means a vibratory motion, said rope engaging means being of a type not able to move upwardly or downwardly on the rope or ropes relative thereto, wherein the exercise apparatus has two ropes with sling or gripping means, wherein the vibration means has two rope engaging members, each of which is configured to be attached to a respective one of the ropes for vibration of the ropes, and wherein the ropes at respective lower end thereof having a sling or gripping means engagable by different body parts of the person, or a sling joining the lower part of the pair of ropes together, wherein the vibration means comprises one common drive motor for the pair of ropes, wherein the drive motor is equipped with a rotating arm transverse to the rotational axis of the motor, which at one outer end is pivotally fastened to a first set of links which is associated with a first rope engaging member, and is also rigidly fastened to a first end of a first link in a second set of links, and wherein the first link in the second set at its second end is pivotally connected to another link in the second set which is associated with a second rope engaging member.

* * * * *